US007186933B2

(12) United States Patent
Turner

(10) Patent No.: US 7,186,933 B2
(45) Date of Patent: Mar. 6, 2007

(54) HANDLE ATTACHMENT, ASSIST MECHANISM THEREFOR, AND ELECTRICAL SWITCHING APPARATUS EMPLOYING THE SAME

(75) Inventor: David C. Turner, Imperial, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/127,721

(22) Filed: May 12, 2005

(65) Prior Publication Data

US 2006/0254896 A1 Nov. 16, 2006

(51) Int. Cl.
*H01H 9/06* (2006.01)

(52) U.S. Cl. ..... 200/50.21; 200/50.26

(58) Field of Classification Search ..... 200/50.21, 200/318, 50.26, 323, 324, 325, 50.01, 400, 200/50.23, 401, 50.02, 43.01–22
See application file for complete search history.

(56) References Cited

U.S. PATENT DOCUMENTS 5,241,290 A 8/1993 Sehmer et al.
5,264,673 A 11/1993 Powell
5,341,191 A 8/1994 Crookston et al.
5,471,184 A 11/1995 Chien et al.
6,031,438 A * 2/2000 Runyan ..... 335/172
6,194,983 B1 2/2001 Bogdon et al.
6,498,310 B1 * 12/2002 Bugryn ..... 200/308
6,504,460 B2 1/2003 DeGrazia et al.
6,577,214 B1 6/2003 DeGrazia et al.
6,803,535 B1 10/2004 Whipple et al.
6,803,536 B1 * 10/2004 Slepian ..... 200/400

* cited by examiner

*Primary Examiner*—Elvin Enad
*Assistant Examiner*—M. Fishman
(74) *Attorney, Agent, or Firm*—Martin J. Moran

(57) ABSTRACT

An assist mechanism is for a handle attachment of a circuit breaker having a housing with an operating member operable among a plurality of positions. The handle attachment includes a casing coupled to the circuit breaker housing and enclosing an actuating assembly which interconnects the circuit breaker operating member with a handle that is operable from the exterior of the casing. The assist mechanism is a wave spring having a first end coupled to the casing, and a second end having a wave bend that divides the second end into three sections having three corresponding tangential vector forces. The tangential vector forces provide a bias to the actuating assembly of the handle attachment that differs depending on the position of the circuit breaker operating member. In this manner, the assist mechanism augments energy generated by movement of the operating member and translates it into a corresponding handle attachment movement.

11 Claims, 4 Drawing Sheets

HANDLE ATTACHMENT, ASSIST MECHANISM THEREFOR, AND ELECTRICAL SWITCHING APPARATUS EMPLOYING THE SAME

BACKGROUND OF THE INVENTION

1. Field of the Invention

The present invention relates generally to electrical switching apparatus and, more particularly to a handle attachment for an electrical switching apparatus, such as a circuit breaker. The invention also relates to an assist mechanism for handle attachments and to electrical switching apparatus having handle attachments with assist mechanisms.

2. Background Information

Circuit breakers are generally old and well known in the art. Examples of circuit breakers are disclosed in U.S. Pat. Nos. 5,341,191 and 5,471,184. Circuit breakers are used to protect electrical circuitry from damage due to a trip condition, such as, for example, an overcurrent condition, an overload condition, an undervoltage condition, or a relatively high level short circuit or fault condition. Molded case circuit breakers, for example, include at least one pair of separable contacts which are operated either manually by way of a handle disposed on the outside of the case, or automatically by way of a trip unit, in response to a trip condition.

Separately attachable handles for circuit breakers are also known. These include a variety of handle attachments, such as rotating handles which often serve secondary functions and include auxiliary features. For example, in addition to providing an operating handle, the handle attachment may also serve as a status indicator (e.g., trip indicator), and it may include a handle locking device. See, e.g., U.S. Pat. No. 6,194,983.

When the handle attachment is attached directly to the face of the molded case circuit breaker, such a configuration is commonly referred to as "closely-coupled." However, not all handle attachments are closely-coupled. Conversely, some are coupled to the circuit breaker by way of an intermediate linkage or actuating assembly. See, e.g., U.S. Pat. No. 6,504,460. For example, circuit breakers are often recessed within a switchgear cabinet or other enclosure. In such instances, the handle attachment may be disposed, for example, on the door of the switchgear cabinet, with the linkage or actuating assembly interconnecting the handle attachment to the operating member of the circuit breaker in order that it may be actuated and, in the instance of a status indicator, a status indication may be seen, from the exterior of the switchgear cabinet.

FIGS. 1 and 2 show a closely-coupled handle attachment 2 as employed on a molded case circuit breaker 4. The handle attachment 2 includes an insulating case 6 which may be coupled to the housing 8 of the circuit breaker 4 by any suitable fastening mechanism, such as the exemplary screws 10, shown in FIG. 1. In the example of FIG. 1, the attachment 2 has a pivoting handle 12 which is operable between three positions, an ON position, an OFF position, and the intermediate tripped position, as shown. Thus, the handle attachment 2 also functions as a status or trip indicator for the circuit breaker 4.

The interior of the handle attachment 2 is shown in FIG. 2. Generally, the handle attachment 2 includes the exterior handle 12 and the actuating assembly 14 for interconnecting and translating energy from the operating member 16 (e.g., handle) of the circuit breaker 4 (shown in phantom line drawing in FIG. 2) to the handle 12 of the attachment 2. The operating member 16 protrudes from an opening (indicated generally by reference 9 in FIG. 2) in the circuit breaker housing 8. In the example of FIG. 2, the actuating assembly 14 comprises a rack 18 with an opening 20 for engaging the circuit breaker operating handle 16, a main gear 22, and a pinion 24 for translating pivotal movement of the circuit breaker operating handle 16 and the associated linear movement of the rack 18, into rotation of the main gear 22 which in turn pivots handle 12 which is coupled thereto. However, any known or suitable mechanism for translating movement of the circuit breaker operating handle 16 into movement of the attachment handle 12 could be employed. The actuating assembly 14 further includes a gear retainer 26 for securing the main gear 22 and pinion 24 in place, and a rack guide 28 which interacts with and moveably supports the rack 18 between the gear retainer 26 and the rack guide 28. The foregoing assembly is described in further detail in U.S. Pat. No. 6,194,983, which is incorporated herein by reference.

In addition to the closely-coupled configuration shown in FIG. 1, the handle attachment 2 can be employed in a variety of non-closely-coupled configurations (not shown), as previously discussed, and in applications such as the example shown in FIG. 2, wherein the attachment 2 is adapted to interact with, for example, the door (not shown) of a switchgear cabinet (not shown). A biasing element, such as the torsion spring 32, is also included in order to facilitate the door interlock member 30 to interact (e.g., interlock) with the cabinet door (not shown).

However, known handle attachments, including those previously described, suffer from a number of disadvantages. Among them is the fact that for relatively small circuit breakers (e.g., without limitation, about 120 to about 150 A, or less), the mechanical advantage (e.g., lever force) provided by the relatively small circuit breaker operating member 16 is often insufficient to move the components (e.g., actuating assembly 14), of the handle attachment 2 and, in particular, the handle 12 thereof. While this is true of all handle attachments (e.g., handle attachment 2 of FIGS. 1 and 2), it is particularly true with respect to handle attachments which are not of the closely-coupled variety (not shown) in which case comparatively significant force is required to translate the energy generated by the moving circuit breaker operating member 16 to the handle 12 of the handle attachment 2. More specifically, the linkage between the operating member 16 and handle 12 can span a distance of as much as about 18 inches (45.72 centimeters), or more. Therefore, the insufficient mechanical force produced by the relatively small operating member 16 of the circuit breaker 4 can potentially fail to move the actuating assembly 14 and thus the handle 12, resulting in an incorrect status indication as shown by the handle 12 on the handle attachment 2. For example, without limitation, for a three-position circuit breaker of the type shown in FIGS. 1 and 2, wherein the tripped handle position is between the ON and OFF positions, movement of the relatively small circuit breaker operating member 16 might not be capable of generating enough leveraging energy to move the handle 12 of the attached handle attachment 2 sufficiently enough to indicate the occurrence of a trip condition.

Additionally, handle assist mechanisms (e.g., without limitation, a torsional spring (not shown); a coil spring (not shown)) that might be contemplated in order to address the foregoing problem, would fail to provide the variation in force required for each of the different operating member 16 positions. For instance, torsion springs and coil (e.g., tension; compression) springs provide an increasing compression force the further they are extended. Therefore, use of such a spring as a handle assist mechanism could result in the operating member 16 being excessively biased, for example, from the ON position or the tripped position toward the OFF position. In other words, a slight bump or other disruption of the circuit breaker 4 or handle attachment 2 could, for example, result in the circuit breaker 4 being undesirably, unintentionally turned OFF. This problem could also occur with relatively small circuit breakers having other operating member configurations (e.g., two-position operating members).

There is, therefore, room for improvement in assist mechanisms for handle attachments, in handle attachments for electrical switching apparatus and in electrical switching apparatus having handle attachments.

SUMMARY OF THE INVENTION

These needs and others are met by the present invention, which is directed to an assist mechanism for handle attachments coupled to electrical switching apparatus. The assist mechanism combines a unique shape and resilient properties to facilitate movement of the operating member of electrical switching apparatus, such as circuit breakers, and to assure that adequate energy is generated in order to move the handle of the handle attachment to a corresponding position.

As one aspect of the invention, an assist mechanism is for a handle attachment including a casing, an actuating assembly, and a handle. The actuating assembly is housed within the casing and the handle is operable from the exterior thereof with the handle attachment being coupled to an electrical switching apparatus including a housing and an operating member operable among a plurality of positions. The actuating assembly of the handle attachment interconnects the operating member and the handle in order to translate movement therebetween. The assist mechanism comprises: a resilient element including a first portion structured to be coupled to the casing of the handle attachment, and a second portion structured to bias the actuating assembly of the handle attachment, wherein the bias is different for at least two of the positions of the operating member of the electrical switching apparatus.

At least the second portion of the resilient element may include a number of bends adapted to define the bias of the actuating assembly in order to augment energy generated by a movement of the operating member of the electrical switching apparatus from one of the positions of the operating member to another of the positions, and to translate the movement into a corresponding movement of the handle of the handle attachment.

The positions of the operating member of the electrical switching apparatus may include an ON position, a tripped position, and an OFF position wherein the handle of the handle attachment includes corresponding ON, tripped, and OFF positions, respectively. The second portion of said resilient element may include at least a second bend having a first section structured to provide as the bias, a first bias when the operating member is in the ON position, a second section structured to provide as the bias, a second bias when the operating member moves from the ON position toward the tripped position in response to a trip condition, and a third section structured to provide as the bias, a third bias when the operating member is in the OFF position. The first bias may be adapted to generally maintain the operating member in the ON position. The second bias may be adapted to bias the actuating assembly of the handle attachment and the handle coupled thereto toward the tripped position, and the third bias may be less than the second bias.

The resilient element may be a wave spring having as the at least a second bend, a wave bend which comprises the first, second and third sections. Each of the first, second and third sections of the wave bend may be structured to provide a tangential vector force which provides the first, second, and third biases of the actuating assembly, respectively.

As another aspect of the invention, a handle attachment is for an electrical switching apparatus including a housing and an operating member operable among a plurality of positions. The handle attachment comprises: a handle; an actuating assembly structured to interconnect the operating member of the electrical switching apparatus and the handle in order to translate a movement of the operating member into a corresponding movement of the handle; a casing enclosing the actuating assembly, the handle being coupled to the casing and being operable from the exterior thereof; and an assist mechanism comprising: a resilient element including a first portion structured to be coupled to the casing of the handle attachment, and a second portion, at least the second portion having at least one bend structured to bias the actuating assembly of the handle attachment in order to augment energy generated by the movement of the operating member of the electrical switching apparatus, and to translate the movement into the corresponding movement of the handle of the handle attachment, wherein the bias is different for at least two of the positions of the operating member.

The actuating assembly may comprise a rack and pinion assembly including a rack, a pinion gear, and a main gear coupled to the handle. The rack may include an opening structured to receive the operating member of the electrical switching apparatus in order to move in response to the movement of the operating member, thereby moving the pinion gear which pivots the main gear and the handle coupled thereto. The second portion of the resilient element may bias a portion of the rack of the actuating assembly when the operating member is disposed in at least one of the positions.

As a further aspect of the invention, an electrical switching apparatus comprises: a housing having an opening; an operating member protruding from the opening, the operating member being operable among a plurality of positions; and a handle attachment comprising: an actuating assembly interconnecting the operating member of the electrical switching apparatus and the handle in order to translate a movement of the operating member into a corresponding movement of the handle, a casing enclosing the actuating assembly, the handle being coupled to the casing and being operable from the exterior thereof, and an assist mechanism comprising a resilient element including a first portion coupled to the casing of the handle attachment, and a second portion, at least the second portion having at least one bend structured to bias the actuating assembly of the handle attachment in order to augment energy generated by the movement of the operating member of the electrical switching apparatus, and to translate the movement into the corresponding movement of the handle of the handle attachment, wherein the bias is different for at least two of the positions of the operating member.

The handle of the handle attachment may be a trip indicator adapted to provide a visual indication to indicate in which of the positions of the operating member of the electrical switching apparatus the operating member is disposed. The electrical switching apparatus may be a circuit breaker and the handle attachment may be a rotary trip indicator.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
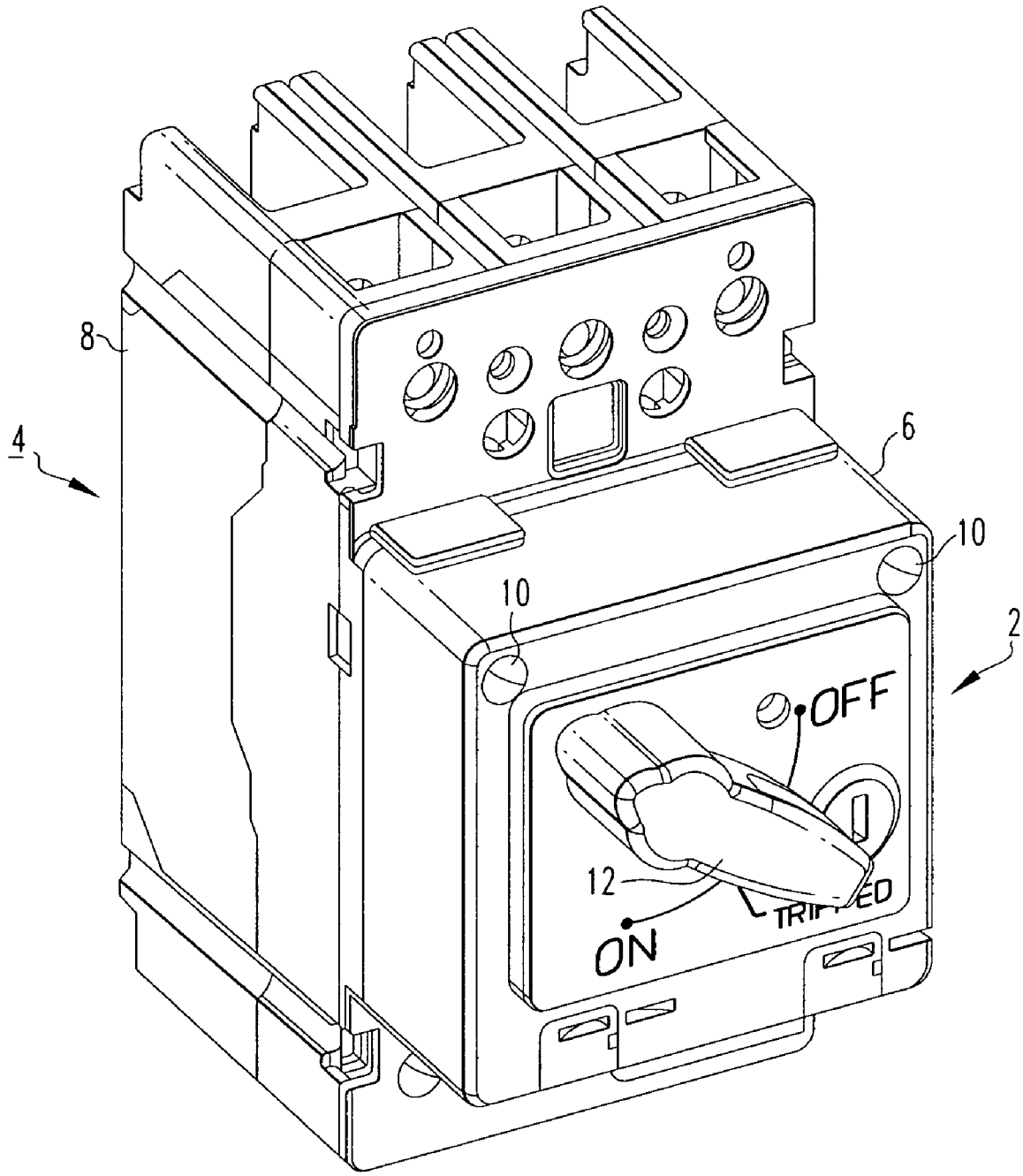
FIG.1 PRIOR ART
FIG. 1 is an isometric view of a circuit breaker having a handle attachment.

For purposes of illustration, the invention will be described as applied to a closely-coupled trip indicator for a molded case circuit breaker, although it will become apparent that it could also be applied to other types of electrical switching apparatus (e.g., without limitation, circuit switching devices and other circuit interrupters such as contactors, motor starters, motor controllers and other load controllers) having an operating mechanism, and to other types of handle attachments (e.g., non-closely coupled actuating levers and indicators) coupled thereto.

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts. A "fastening mechanism," as used herein, expressly includes, but is not limited to fasteners, as previously defined, as well as any other known or suitable means for adhering (e.g., without limitation, glue, tape, or other adhesives) two or more components together.

As employed herein, the statement that two or more parts are "coupled" together shall mean that the parts are joined together either directly or joined through one or more intermediate parts.

As employed herein, the term "number" shall mean one or more than one (i.e., a plurality).

As employed herein, the term "trip condition" refers to any abnormal electrical condition which could cause a circuit breaker or other electrical switching apparatus to trip expressly including, without limitation, an overcurrent condition, an overload condition, an undervoltage condition, or a relatively high level short circuit or fault condition.

Figure 2:
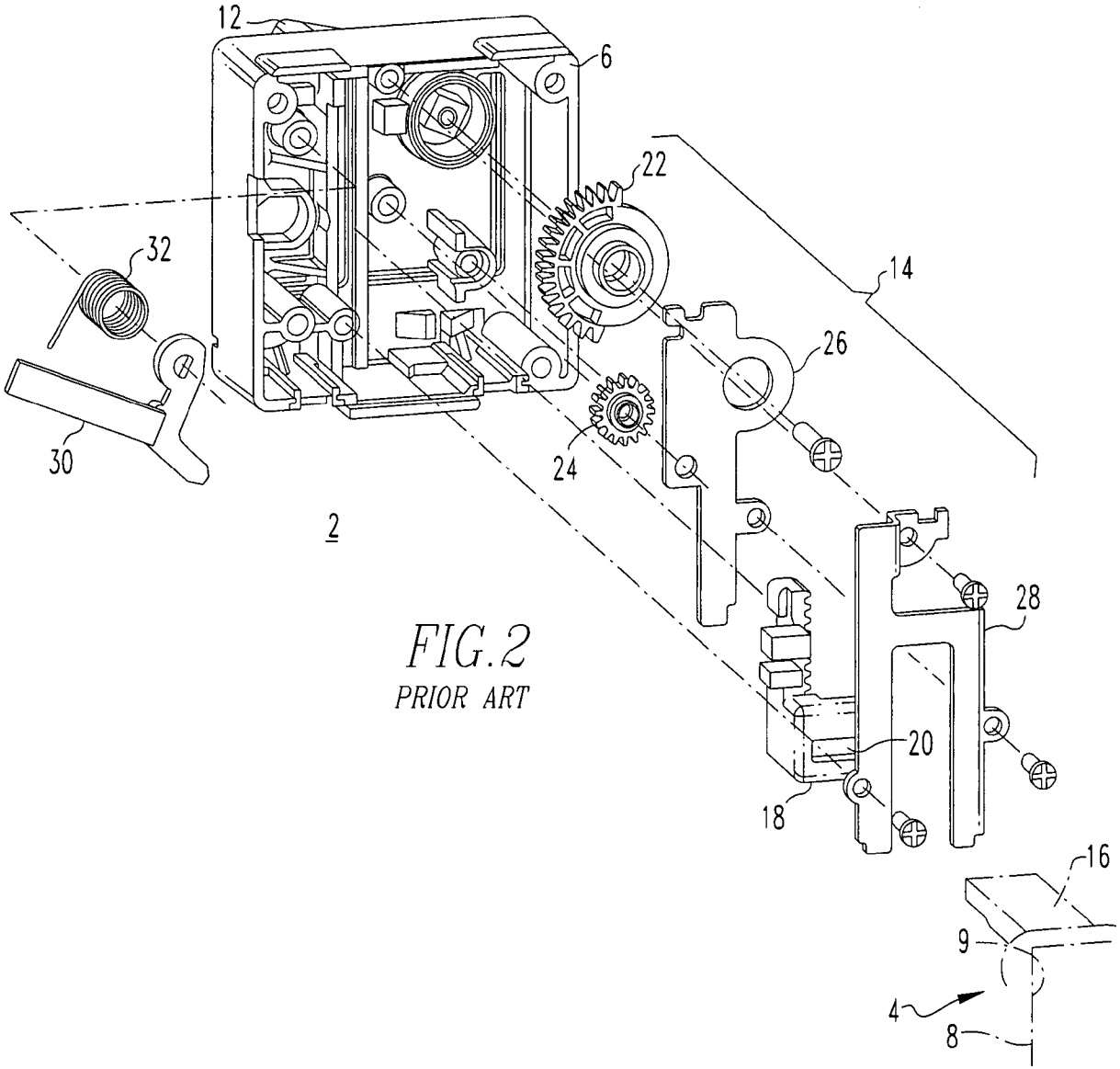
FIG. 2 PRIOR ART
FIG. 2 is an exploded, isometric view of the interior components of the handle attachment of FIG. 1.
Figure 3:
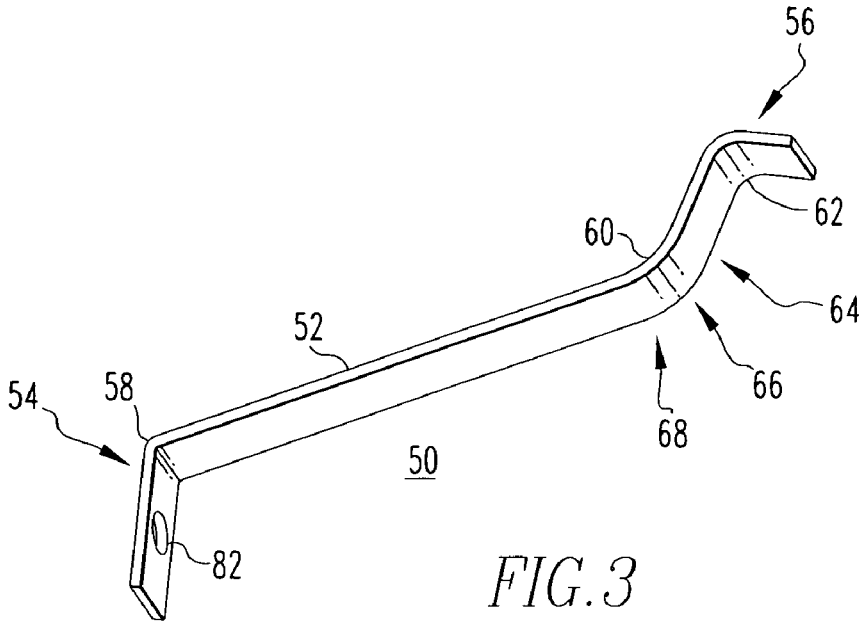
FIG. 3 is an isometric view of an assist mechanism for use with a handle attachment in accordance with the invention.

FIG. 3 shows an assist mechanism 50 for a handle attachment 102 (FIGS. 4, 5A, 5B, 6A and 6B) in accordance with the invention. Generally, the assist mechanism 50 comprises a resilient element 52 including a first portion 54 and a second portion 56. As will be discussed herein, the second portion 56 is structured to bias the actuating assembly 114 (FIGS. 4, 5B and 6B) of the handle attachment 102 (FIGS. 4, 5A, 5B, 6A and 6B). In the example shown and described herein, the resilient element 52 of the assist mechanism 50 is a wave spring 52 made from a bent metallic material. However, any known or suitable resilient material could alternatively be employed. The first and second portions of the exemplary wave spring 52 are first and second ends 54 and 56, each having at least one bend 58 and 60, 62, respectively. In the example of FIG. 3, the first end 54 has a first bend 58 and the second end 56 has at least a second bend 60, 62 with the exemplary second end 56 having a wave bend consisting of two bends 60, 62, as shown. The wave bend 60, 62 defines first, second and third sections 64, 66, 68 of the wave spring 52, proximate the second end 56 thereof. As will be discussed herein, these sections 64, 66, 68 enable the assist mechanism 50 of the invention to bias the actuating assembly 114 (FIGS. 4, 5B and 6B) such that the bias is different for at least two of the aforementioned positions (described previously with reference to FIGS. 1 and 2) of the operating member 16 (FIG. 2) of the circuit breaker 4 (FIGS. 1 and 2).

Figure 4:
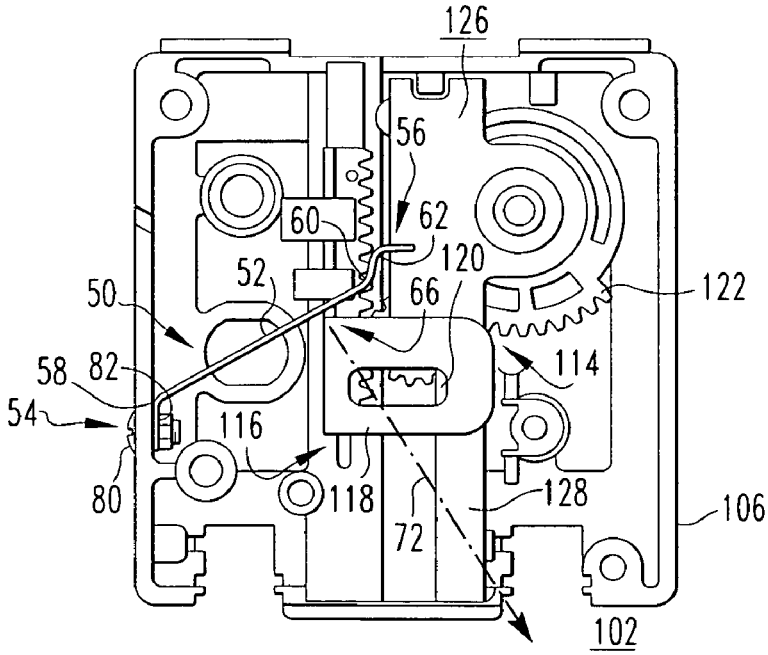
FIG. 4 is a back elevational view of a portion of a handle attachment, shown in the tripped position, and employing the assist mechanism of FIG. 3.
Figure 5A:
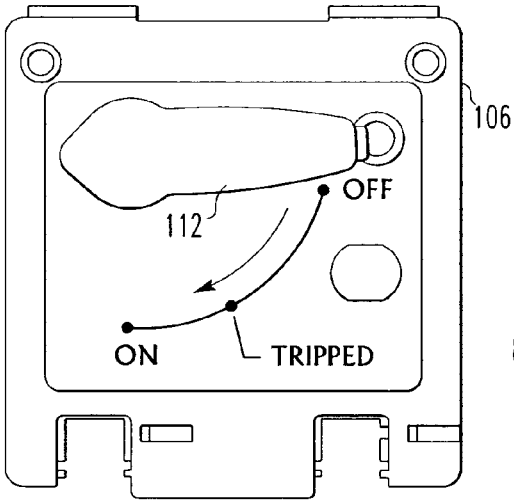
FIG. 5A is a front elevational view of the handle attachment of FIG. 4, modified to show the handle in the OFF position.
Figure 5B:
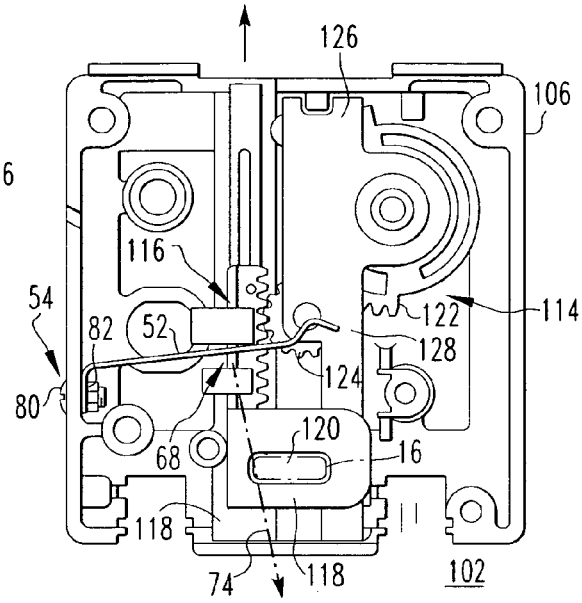
FIG. 5B is a back elevational view of the handle attachment of FIG. 5A.
Figure 6A:
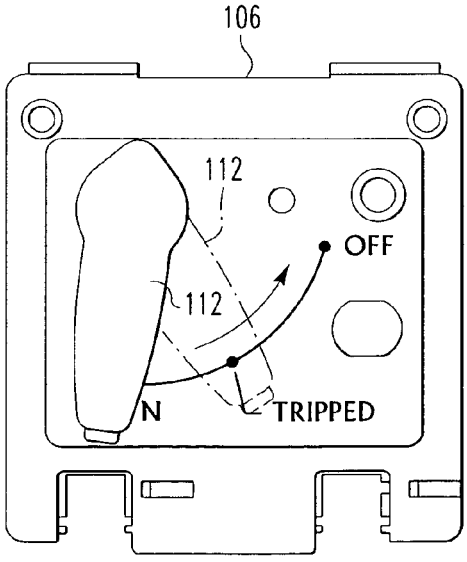
FIG. 6A is a front elevational view of the handle attachment of FIG. 5A, but modified to show the handle in the ON position.
Figure 6B:
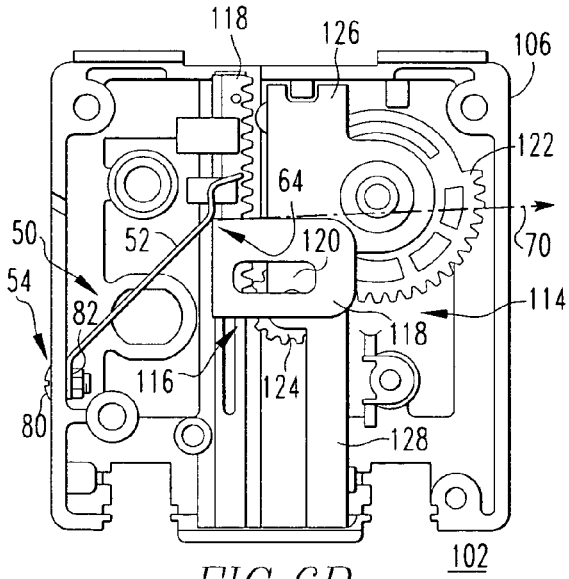
FIG. 6B is a back elevational view of the handle attachment of FIG. 6A.

FIGS. 4, 5B and 6B show the interior components of the exemplary handle attachment 102 and FIGS. 5A and 6A show the exterior thereof. For simplicity of disclosure, the handle attachment 102 will be described as applied to the circuit breaker 4 and operating member 16 thereof, of FIGS. 1 and 2. However, it will be appreciated that it could also be applied to a wide variety of other circuit breakers and electrical switching apparatus (not shown).

As shown in FIGS. 5A and 6A, the exemplary handle attachment is a rotary trip indicator 102 including a casing 106 with a handle 112 pivotally coupled thereto. The casing 106 is structured to couple to the housing 8 of the circuit breaker 4 of FIG. 1. In this manner, the operating member 16 (FIG. 2) of the circuit breaker 4 (FIGS. 1 and 2) is interconnected with the handle 112 of the trip indicator 102 in order to translate movement therebetween. Accordingly, the operating member 16 may be operated by actuating the handle 112 from the exterior of the handle attachment casing 106 and, the handle 112 also serves to function as an indicator for providing a visual indication of the position of the circuit breaker operating member 16 (FIG. 2) and thus the status (e.g., tripped; ON; OFF) of the circuit breaker 4.

As shown in FIGS. 1, 5A and 5B, respectively, the handle 112 of the handle attachment 102 includes corresponding ON, tripped, and OFF positions. In order to overcome the aforementioned problems of the operating member 16 (FIG. 2) failing to generate sufficient energy in response to a trip condition in order to provide the corresponding movement of the handle attachment handle 112, and of the circuit breaker 4 (FIGS. 1 and 2) unintentionally turning OFF due to excessive bias toward the OFF position, the bends (e.g., 60, 62) and sections (e.g., 64, 66, 68) of the exemplary wave spring 52 (best shown in FIG. 3) provide the different biases for at least two of the positions of the circuit breaker operating member 16 (FIG. 2) as will now be described. In this manner, the wave spring 52 augments energy generated by the movement of the operating member 16 (FIG. 2) from one of the positions of the operating member 16 to another of the positions, thereby facilitating the translation of that movement into the corresponding movement of the handle 112 of the handle attachment 102, for example, when moving from the ON position (FIG. 6A) to the tripped position (shown in phantom line drawing in FIG. 6A).

More specifically, as shown in FIGS. 4, 5B and 6B, each of the exemplary first, second and third sections 64 (FIG. 6B), 66 (FIG. 4), 68 (FIG. 5B) of the exemplary wave spring 52 are adapted to provide as the bias to the actuating mechanism 114, first, second and third biases in the form of corresponding first, second and third tangential vector forces 70 (FIG. 6B), 72 (FIG. 4), and 74 (FIG. 5B), respectively. In the example shown and described herein, the first bias is adapted to generally maintain the handle 112 and thus the operating member 16 (FIG. 2) in the ON position (FIG. 6A), and the second bias is adapted to bias the actuating assembly 114 of the handle attachment 102 and the handle 112 coupled thereto, toward the tripped position. The second bias and the second vector force 72 are best understood with reference to FIG. 4 which shows the interior of the handle attachment 102 and, in particular, the actuating assembly 114, corresponding to the tripped position of the handle (see, e.g., handle 12) of FIG. 1. The exemplary third bias is less than the second bias. Specifically, the third section 68 of the exemplary wave spring 52 provides the third tangential vector force 74, as shown. However, because the handle 112 (FIG. 5A) is typically manually turned to the OFF position, the third bias does not need to be as great as the second bias, which adapted to assist movement from the ON position to the tripped position, automatically in response to a trip condition. It will be appreciated that, in fact, no third bias is required. It will also be appreciated that a wide variety of different biases and different wave spring configurations (not shown) structured to provide a variety of different tangential vector forces other than those shown and described herein, could be employed.

As shown in FIG. 4, the second tangential vector force 72 provided by the second section 66 of the exemplary wave spring 52 engages and biases the rack 118 of the actuating assembly 114. The exemplary actuating assembly is a rack and pinion assembly 116 including the rack 118, a main gear 122, a pinion 124 (best shown in FIGS. 5B and 6B), a gear retainer 126, and a rack guide 128, all of which, but excluding the assist mechanism 50, are essentially identical to the components of the rack and pinion actuating assembly 14 of FIG. 2. In operation, when the circuit breaker 4 (FIGS. 1 and 2) trips in response to a trip condition, the circuit breaker operating member (e.g., operating member 16 shown in phantom line drawing in FIG. 2 and partially shown in phantom line drawing in FIG. 5B), which is disposed within opening 120 of the rack 118, initiates movement of the rack 118 in order to overcome the aforementioned first bias and move towards the tripped position (FIG. 4). More specifically, the second section 66 of the wave spring 52 and the exemplary second tangential vector force 72 provided thereby, bias the rack 18 in order to augment the tripping motion and to assure that the handle (e.g., handle 12 of FIG. 1) continues toward the tripped position shown in FIG. 1. Accordingly, the wave spring 52 of the invention provides a first bias when the circuit breaker operating member 16 and handle attachment handle 112 are in the ON position (FIG. 6A) and the second bias, which is different, when a trip condition occurs and the operating member 16 (FIG. 2) moves toward the tripped position. In this manner, the exemplary assist mechanism 50 overcomes what is commonly referred to in the art as a "stuck handle" condition in which the circuit breaker trips, for example, but the operating member 16 (FIG. 2) and a handle attachment handle fail to move. The exemplary tangential vector forces (e.g., 72), help alleviate or overcome such stuck handle conditions.

Referring now to FIGS. 5A and 5B, the outside and inside of the exemplary handle attachment 102 are shown as positioned when the handle 112 is disposed in the OFF position. As shown in FIG. 5B, the third section 68 of the exemplary wave spring 52 provides the third bias by way of the third tangential vector force 74. However, as previously discussed, the third bias may be essentially zero because the handle 112 (FIG. 5A) is typically manually moved to the OFF position thereby not requiring a bias to facilitate movement of the actuating assembly 114 (FIG. 5B). It will be understood, however, that in other circumstances which are contemplated by the invention, a third bias may be desired. For example, a third bias may be desirable to make the operation of turning the breaker OFF easier for the operator. It will, therefore, be appreciated that the exact amount of the forces provided by the first second and third biases are not a limiting aspect of the invention.

FIGS. 6A and 6B show the outside and inside of the exemplary handle attachment 102, respectively, when the handle 112 is disposed in the ON position. When the handle 112 (FIG. 6A) and thus the circuit breaker operating member 16 (FIG. 2) are in the ON position, the rack 118 of the exemplary actuating assembly 114 is disposed at its upward most (from the prospective of FIG. 6B) position. In the example of FIG. 6B, this results in the upper left corner (with respect to FIG. 6B) of the portion of the rack 118 having opening 120, being engaged and biased by the first section 64 of the exemplary wave spring 52. Specifically, the first section 64 provides the first tangential vector force 70 of FIG. 6B, which, as previously discussed, provides the first bias that generally functions to maintain the position of the rack 118 and thus the handle 112 coupled indirectly (by way of main gear 122 and pinion 124) thereto. In this manner, the exemplary assist mechanism 50 prevents the handle 112 (FIG. 6A) from being unintentionally biased to the tripped or OFF positions by, for example, merely bumping the handle attachment 102 or circuit breaker 4 (FIGS. 1 and 2), as previously discussed.

As previously discussed, the exact amount of each bias, for example, the tangential vector forces 70, 72, 74, is not limiting upon the invention. The wave spring 52 or other suitable resilient element could be structured to provide any known or suitable bias in a wide variety of tangential vector force directions other than those shown and described herein. It will also be appreciated that the resilient element 52 could be made from another material, in another configuration, and with a different shape and dimension. For instance, the exemplary wave spring 52 could be made from a similar or the same metallic material but having a greater thickness or gauge, in order to increase or otherwise change the bias forces applied to the actuating assembly 114. Such an embodiment might be desirable, for example, in an application in which another handle attachment (not shown), which is not closely-coupled, is interconnected with the circuit breaker operating member (e.g., operating member 16 of circuit breaker 4 of FIG. 2) and requires relatively greater biasing force to actuate. It will still further be appreciated that, while the exemplary wave spring 52 employs a fastener, such as the screw and nut combination 80 inserted through aperture 82 in the first portion 54 of the wave spring 52, in order to secure the wave spring 52 to the casing 106, as shown, any other known or suitable fastening mechanism could be employed. For example, the first portion 54 could be glued or otherwise adhered to the interior of the casing 106 without requiring a separate fastener 80.

Accordingly, the exemplary assist mechanism 50 combines resilient properties and a unique set of bends in the wave spring 52 in order to provide a number of different biases which appropriately correspond to the position of the handle attachment handle and the circuit breaker operating member interconnected therewith.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a housing having an opening and an exterior;

an operating member protruding from said opening, said operating member being operable among a plurality of positions; and a handle attachment including a handle, said handle attachment comprising:

an actuating assembly interconnecting said operating member of said electrical switching apparatus and said handle in order to translate a movement of said operating member into a corresponding movement of said handle, a casing enclosing said actuating assembly, said handle being coupled to said casing and being operable from the exterior thereof, and an assist mechanism comprising a resilient element including a first portion coupled to said casing of said handle attachment, and a second portion, at least the second portion having at least one bend structured to bias said actuating assembly of said handle attachment in order to augment energy generated by said movement of said operating member of said electrical switching apparatus, and to translate said movement into said corresponding movement of said handle of said handle attachment, wherein said bias is different for at least two of said positions of said operating member, wherein said handle attachment is coupled to the exterior of said housing, and wherein said handle attachment is over said operating member protruding from the opening of said housing.

2. The electrical switching apparatus of claim 1 wherein the first portion of said resilient element is a first end including an aperture; and wherein said assist mechanism includes a fastener inserted through said aperture, said fastener securing the first end of said resilient element to said casing of said handle attachment.

3. An electrical switching apparatus comprising:

a housing having an opening;

an operating member protruding from said opening, said operating member being operable among a plurality of positions; and a handle attachment including a handle, said handle attachment comprising:

an actuating assembly interconnecting said operating member of said electrical switching apparatus and said handle in order to translate a movement of said operating member into a corresponding movement of said handle, a casing enclosing said actuating assembly, said handle being coupled to said casing and being operable from the exterior thereof, and an assist mechanism comprising a resilient element including a first portion coupled to said casing of said handle attachment, and a second portion, at least the second portion having at least one bend structured to bias said actuating assembly of said handle attachment in order to augment energy generated by said movement of said operating member of said electrical switching apparatus, and to translate said movement into said corresponding movement of said handle of said handle attachment, wherein said bias is different for at least two of said positions of said operating member, and wherein said at least one bend of at least the second portion of said resilient element includes a plurality of sections corresponding to said positions of said operating member of said electrical switching apparatus and said handle coupled thereto; wherein said sections of said at least one bend include a first section, a second section, and a third section; wherein said first section is structured to provide a first bias of said actuating assembly; wherein said second section is structured to provide a second bias; and wherein said third section is structured to provide a third bias.

4. The electrical switching apparatus of claim 3 wherein said positions of said operating member of said electrical switching apparatus include an ON position, a tripped position, and an OFF position; wherein said handle has corresponding ON, tripped and OFF positions, respectively; wherein said first bias of said actuating assembly is adapted to generally maintain said operating member in said ON position; and wherein said second bias is adapted to bias said actuating assembly and said handle coupled thereto towards said tripped position in response to a trip condition.

5. The electrical switching apparatus of claim 3 wherein said resilient element is a wave spring having said first and second portions; wherein said first and second portions of said wave spring are a first end and a second end; wherein said at least one bend of at least the second end of said wave spring comprises a first bend proximate the first end, and a wave bend proximate the second end, said wave bend including said first, second, and third sections; wherein each of said first, second, and third sections is structured to provide a tangential vector force; and wherein said tangential vector forces of said first, second, and third sections provide said first, second, and third biases of said actuating assembly, respectively.

6. The electrical switching apparatus of claim 1 wherein said handle of said handle attachment is a trip indicator; and wherein said trip indicator is adapted to provide a visual indication to indicate in which of said positions of said operating member of said electrical switching apparatus, said operating member is disposed.

7. The electrical switching apparatus of claim 1 wherein said electrical switching apparatus is a circuit breaker; and wherein said handle attachment is a rotary trip handle.

8. An assist mechanism for a handle attachment including a casing, an actuating assembly, and a handle, said actuating assembly being housed within said casing and said handle being operable from the exterior thereof, said handle attachment being coupled to an electrical switching apparatus including a housing and an operating member operable among a plurality of positions, said actuating assembly of said handle attachment interconnecting said operating member and said handle in order to translate movement therebetween, said assist mechanism comprising:

a resilient element including a first portion structured to be coupled to said casing of said handle attachment, and a second portion structured to bias said actuating assembly of said handle attachment, wherein said bias is different for at least two of said positions of said operating member of said electrical switching apparatus;

wherein at least the second portion of said resilient element includes a number of bends; and wherein said bends are adapted to define said bias of said actuating assembly in order to augment energy generated by a movement of said operating member of said electrical switching apparatus from one of said positions of said operating member to another of said positions, and to translate said movement into a corresponding movement of said handle of said handle attachment;

wherein said resilient element includes a first bend proximate the first portion; and wherein the second portion of said resilient element includes at least a second bend proximate the second portion which is structured to engage and bias said actuating assembly;

wherein said positions of said operating member of said electrical switching apparatus include an ON position, a tripped position, and an OFF position; wherein said handle of said handle attachment includes corresponding ON, tripped, and OFF positions, respectively; wherein said at least a second bend includes a first section structured to provide a first bias when said operating member is in said ON position, a second section structured to provide a second bias when said operating member moves from said ON position toward said tripped position in response to a trip condition, and a third section structured to provide a third bias when said operating member is in said OFF position; and wherein said first bias is adapted to generally maintain said operating member in said ON position; wherein said second bias is adapted to bias said actuating assembly of said handle attachment and said handle coupled thereto toward said tripped position; and wherein said third bias is less than said second bias.

9. An assist mechanism for a handle attachment including a casing, an actuating assembly, and a handle, said actuating assembly being housed within said casing and said handle being operable from the exterior thereof, said handle attachment being coupled to an electrical switching apparatus including a housing and an operating member operable among a plurality of positions, said actuating assembly of said handle attachment interconnecting said operating member and said handle in order to translate movement therebetween, said assist mechanism comprising:

a resilient element including a first portion structured to be coupled to said casing of said handle attachment, and a second portion structured to bias said actuating assembly of said handle attachment, wherein said bias is different for at least two of said positions of said operating member of said electrical switching apparatus;

wherein at least the second portion of said resilient element includes a number of bends; and wherein said bends are adapted to define said bias of said actuating assembly in order to augment energy generated by a movement of said operating member of said electrical switching apparatus from one of said positions of said operating member to another of said positions, and to translate said movement into a corresponding movement of said handle of said handle attachment;

wherein said resilient element includes a first bend proximate the first portion; and wherein the second portion of said resilient element includes at least a second bend proximate the second portion which is structured to engage and bias said actuating assembly;

wherein said positions of said operating member of said electrical switching apparatus include an ON position, a tripped position, and an OFF position; wherein said handle of said handle attachment includes corresponding ON, tripped, and OFF positions, respectively; wherein said at least a second bend includes a first section structured to provide a first bias when said operating member is in said ON position, a second section structured to provide a second bias when said operating member moves from said ON position toward said tripped position in response to a trip condition, and a third section structured to provide a third bias when said operating member is in said OFF position; and wherein said resilient element is a wave spring having as said at least a second bend, a wave bend which comprises said first, second and third sections; wherein each of said first, second and third sections of said wave bend is structured to provide a tangential vector force; and wherein said tangential vector forces of said first, second, and third sections provide said first, second, and third biases of said actuating assembly, respectively.

10. A handle attachment for an electrical switching apparatus including a housing and an operating member operable among a plurality of positions, said handle attachment comprising:

a handle;

an actuating assembly structured to interconnect said operating member of said electrical switching apparatus and said handle in order to translate a movement of said operating member into a corresponding movement of said handle;

a casing enclosing said actuating assembly, said handle being coupled to said casing and being operable from the exterior thereof; and an assist mechanism comprising:

a resilient element including a first portion structured to be coupled to said casing of said handle attachment, and a second portion, at least the second portion having at least one bend structured to bias said actuating assembly of said handle attachment in order to augment energy generated by said movement of said operating member of said electrical switching apparatus, and to translate said movement into said corresponding movement of said handle of said handle attachment, wherein said bias is different for at least two of said positions of said operating member; and wherein said actuating assembly comprises a rack and pinion assembly including a rack, a pinion gear, and a main gear coupled to said handle; wherein said rack includes an opening structured to receive said operating member of said electrical switching apparatus in order to move in response to said movement of said operating member, thereby moving said pinion gear which pivots said main gear and said handle coupled thereto; and wherein the second portion of said resilient element biases a portion of said rack of said actuating assembly when said operating member is disposed in at least one of said positions.

11. A handle attachment for an electrical switching apparatus including a housing and an operating member operable among a plurality of positions, said handle attachment comprising:

a handle;

an actuating assembly structured to interconnect said operating member of said electrical switching apparatus and said handle in order to translate a movement of said operating member into a corresponding movement of said handle;

a casing enclosing said actuating assembly, said handle being coupled to said casing and being operable from the exterior thereof; and an assist mechanism comprising:

a resilient element including a first portion structured to be coupled to said casing of said handle attachment, and a second portion, at least the second portion having at least one bend structured to bias said actuating assembly of said handle attachment in order to augment energy generated by said movement of said operating member of said electrical switching apparatus, and to translate said movement into said corresponding movement of said handle of said handle attachment, wherein said bias is different for at least two of said positions of said operating member; and wherein said at least one bend of at least the second portion of said resilient element includes a plurality of sections corresponding to said positions of said operating member of said electrical switching apparatus and said handle coupled thereto; wherein said sections of said at least one bend include a first section, a second section, and a third section; wherein said first section is structured to provide a first bias; wherein said second section is structured to provide a second bias; and wherein said third section is structured to provide a third bias; and wherein said resilient element is a wave spring having as said first and second portions, a first end and a second end; wherein said at least one bend of at least the second end of said wave spring comprises a first bend proximate the first end, and a wave bend proximate the second end; wherein said wave bend comprises said first, second, and third sections; wherein each of said first, second, and third sections is structured to provide a tangential vector force; and wherein said tangential vector forces of said first, second, and third sections provide said first, second, and third biases of said actuating assembly, respectively.

* * * * *